US007253771B2

(12) United States Patent
Maniwa et al.

(10) Patent No.: US 7,253,771 B2
(45) Date of Patent: Aug. 7, 2007

(54) ANTENNA DEVICE

(75) Inventors: Toru Maniwa, Kawasaki (JP); Andrey S. Andrenko, Kawasaki (JP); Shigekazu Kimura, Kawasaki (JP)

(73) Assignee: Fujitsu Limited, Kanagawa (JP)

( * ) Notice: Subject to any disclaimer, the term of this patent is extended or adjusted under 35 U.S.C. 154(b) by 0 days.

(21) Appl. No.: 11/130,245

(22) Filed: May 17, 2005

(65) Prior Publication Data

US 2006/0187135 A1 Aug. 24, 2006

(30) Foreign Application Priority Data

Feb. 24, 2005 (JP) ..... 2005-048230

(51) Int. Cl.
*H01Q 1/38* (2006.01)
*H01Q 9/16* (2006.01)

(52) U.S. Cl. ..... 343/700 MS; 343/793

(58) Field of Classification Search ..... 343/700 MS, 343/793, 795, 702
See application file for complete search history.

(56) References Cited

U.S. PATENT DOCUMENTS 4,191,959 A * 3/1980 Kerr ..... 343/700 MS
4,208,660 A * 6/1980 McOwen, Jr. ..... 343/769
5,526,007 A * 6/1996 Murakami et al. ..... 343/741
6,906,669 B2 * 6/2005 Sabet et al. ..... 343/700 MS
7,064,713 B2 * 6/2006 Koenig ..... 343/700 MS
7,119,745 B2 * 10/2006 Gaucher et al. ..... 343/700 MS
2003/0076260 A1 * 4/2003 Ryken et al. ..... 343/700 MS
2005/0237260 A1 * 10/2005 Bancroft ..... 343/859

FOREIGN PATENT DOCUMENTS

JP 07-131221 5/1995

* cited by examiner

*Primary Examiner*—Trinh Vo Dinh
(74) *Attorney, Agent, or Firm*—Bingham McCutchen LLP

(57) ABSTRACT

An antenna device is disclosed. An antenna such as a dipole antenna and a parallel feeder each formed of a conductor pattern are disposed on a dielectric plate. The connector is connected to the antenna through the parallel feeder. The parallel feeder has a length of an integral multiple of a half wavelength and has an even number of bending points between the connector and the antenna.

3 Claims, 8 Drawing Sheets

PRIOR ART

PRIOR ART

ANTENNA DEVICE

BACKGROUND OF THE INVENTION

1. Field of the Invention

The present invention relates to an antenna device having an antenna and a parallel feeder on a dielectric plate.

2. Description of the Related Art

A planar small antenna device of the type having an antenna such as a dipole antenna on/in a dielectric plate made of synthetic resin or glass is known in the art. An example of this type of antenna device is shown in FIG. 9. The antenna device of FIG. 9 has a dipole antenna 12 formed of a conductor pattern on a dielectric plate 11. The dipole antenna 12 is connected through a coaxial cable 13 to a connector 14 fixed to an end of the dielectric plate 11. The connector 14 is connected to a radio transmitter/receiver, so radio communications with other devices are established through the dipole antenna 12. The coaxial cable 13 is fixed at plural points by metal retainers 15.

FIG. 10 illustrates another example of this type of antenna device. As shown in FIG. 10, one antenna element of a dipole antenna 22 is formed on the front side of a dielectric plate 1, while the other antenna element is formed on the back side of the dielectric plate 1. The dipole antenna 22 is connected to a connector 24 through a feeder 23. The feeder 23 has a microstrip line configuration where conductor patterns are formed on the front and back sides of the dielectric plate 21.

FIG. 11 illustrates a still another well-known example, wherein a dipole antenna 32 formed of a conductor pattern is disposed on a dielectric plate 31, and is connected through a parallel feeder 33 to a connector 34 at an end of the dielectric plate 31. Portable radio equipment disclosed in Japanese Patent Laid-Open Publication No. 7-131221 has a configuration in which a linear antenna of a quarter wavelength and a meandering antenna element are connected through a parallel feeder to radio transmitter/receiver circuit in a housing.

There are various systems of the type having an antenna on a dielectric plate made of synthetic resin or glass to be used for communications with other devices. These systems are applicable as an antenna for the above-described portable radio equipment and as an information reading side antenna for RFID (Radio Frequency Identification Tag) systems. RFID systems are currently used in the 860-960 MHz band and in the 2.4 GHz band. If the antenna device of FIG. 9 is applied to these systems or other various radio communication systems, they need to be carefully treated during production and use. This is because the coaxial cable 13 is used as the feeder in the antenna device of FIG. 9, and the metal retainers 15 are used for fixing the coaxial cable 13 to the dielectric plate 11.

On the other hand, although the antenna device of FIG. 10 does not use retainers, the antenna device of FIG. 10 needs to have conductor patterns on both sides of the dielectric plate 21, thereby having higher production costs than antenna devices having a conductor pattern on one side. The antenna device of FIG. 11 can be produced more easily than the antenna devices of FIGS. 9 and 10, because the dipole antenna 32 and the feeder 33 are formed of conductor patterns and are disposed only on one side of the dielectric plate 31. However, in the antenna device of FIG. 11 and the above-described portable radio equipment, the parallel feeder has one bending point, and therefore there is a difference in length of a pair of lines of the parallel feeder, resulting in lowering of antenna properties.

SUMMARY OF THE INVENTION

An object of the present invention is to provide an antenna device to solve at least one problem described above. A specific object of the present invention is to provide an antenna device having a parallel feeder that comprises a pair of lines of the same electric length so as to prevent lowering of antenna properties while offsetting null directions.

According to the present invention, there is provided an antenna device that comprises a dielectric plate, an antenna formed of a conductor pattern and disposed on the dielectric plate, a connector disposed on the dielectric plate, and a parallel feeder formed of a conductor pattern to connect the antenna to the connector, wherein the parallel feeder has a length of an integral multiple of a half wavelength and has an even number of bending points between the connector and the antenna.

It is preferable that the bending points of the parallel feeder be curved.

According to another aspect of the present invention, there is provided an antenna device that comprises a dielectric plate, an antenna formed of a conductor pattern and disposed on the dielectric plate, a connector disposed on the dielectric plate, and a parallel feeder formed of a conductor pattern to connect the antenna to the connector, wherein the parallel feeder includes a first parallel feeder part, and a second parallel feeder part having one end connected to the first parallel feeder part and the other end connected to the connector; the dielectric plate includes a first dielectric plate on which the first parallel feeder part and the antenna are disposed, and a second dielectric plate which is fixed to the first dielectric plate to be substantially orthogonal to the first dielectric plate and on which the connector and the second parallel feeder part are arranged; and the parallel feeder has a length of an integral multiple of a half wavelength and has an even number of bending points between the connector and the antenna.

According to still another aspect of the present invention, there is provided an antenna device that comprises first and second dielectric plates, respectively, arranged in a horizontal direction and a vertical direction, first and second antennas formed of conductor patterns and respectively disposed on the first dielectric plate and the second dielectric plate, first and second connectors respectively disposed on the first dielectric plate and the second dielectric plate, and first and second parallel feeders formed of conductor patterns to respectively connect the first antenna to the first connector and the second antenna to the second connector, wherein each of the first parallel feeder and the second parallel feeder has a length of an integral multiple of a half wavelength and has an even number of bending points.

According to a further other aspect of the present invention, there is provided an antenna device that comprises a dielectric plate, mutually-perpendicular first and second antennas disposed on the same plane on the dielectric plate, first and second connectors disposed on the dielectric plate, first and second parallel feeders to respectively connect the first antenna to the first connector and the second antenna to the second connector, and a feeder section to feed power to the first antenna or the second antenna by switching between the first and second antennas or to feed power to the first and second antennas while differentiating feeding phases thereof, wherein each of the first parallel feeder and the second parallel feeder has a length of an integral multiple of a half wavelength and has an even number of bending points.

According to the present invention, since one or more antennas and one or more parallel feeders are formed of conductor patterns and disposed on the dielectric plate, the antenna device of the present invention can be easily produced. Furthermore, since the feeder has a length of an integral multiple of a half wavelength and has an even number of bending points, lowering of antenna properties is prevented. In the case where two antennas are provided, plural polarization plates are formed and thereby null directions of the antennas are offset.

DETAILED DESCRIPTION OF THE PREFERRED EMBODIMENT

Figure 1:
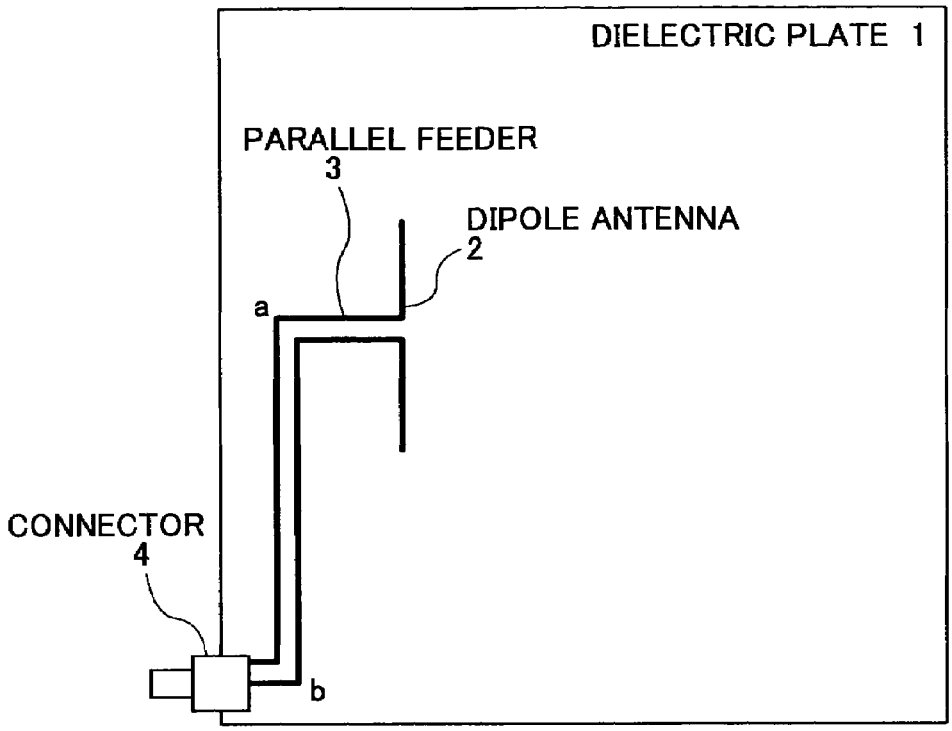
FIG. 1 illustrates a first embodiment of the present invention.

An antenna device of the present invention is shown in FIG. 1, wherein an antenna such as a dipole antenna 2 and a parallel feeder 3 each formed of a conductor pattern are disposed on a dielectric plate 1 made of glass or the like. The dipole antenna 2 is connected to a connector 4 through the parallel feeder 3. The parallel feeder 3 has a length of an integral multiple of a half wavelength, and has an even number of bending points between the connector 4 and the antenna 2.

First Embodiment

FIG. 1 illustrates a first embodiment of the present invention, showing the dielectric plate denoted by the reference number 1, the dipole antenna denoted by 2, the parallel feeder denoted by 3, and the connector denoted by 4. The dielectric plate 1 may be a glass plate having a thickness of a few millimeters in view of mechanical strength. Alternatively, a synthetic resin plate having low dielectric loss may be used as the dielectric plate 1. The connector 4 is connected to a radio unit (not shown). Each of the dipole antenna 2 and the feeder 3 is formed of a conductor pattern with a width of a few millimeters formed by, for example, screen printing with silver paste. Alternatively, the dipole antenna 2 and the feeder 3 may be formed by existing print wiring techniques. If the dielectric plate 1 is a glass plate, the dipole antenna 2 and the feeder 3 may be made of materials such as ITO (Indium Tin Oxide) known as transparent electrodes. The conductor pattern may alternatively be a thin metal wire mesh having wire diameter of a few μm to be less outstanding. The dipole antenna 2 and the feeder 3 on the dielectric plate 1 may be covered by a thin dielectric plate for protection.

The feeder 3 generally has some bending points to connect the dipole antenna 2 to the connector 4 on the dielectric plate 1 due to the positional relationship between the dipole antenna 2 and the connector 4. The feeder 3 of this embodiment is formed to have bending points a, b and to have a length of an integral multiple of a half wavelength. While there are two bending points a, b in this embodiment, even numbers (e.g. 4, 6, . . . ) of bending points may be formed if more than two bending points are required. This is because, when there are an even numbers of bending points, two lines of the parallel feeder 3 have the same length and thus the lowering of propagation properties of the feeder 3 is prevented. The dipole antenna 2 may include a pattern of a folded-dipole antenna.

Second Embodiment

Figure 2:
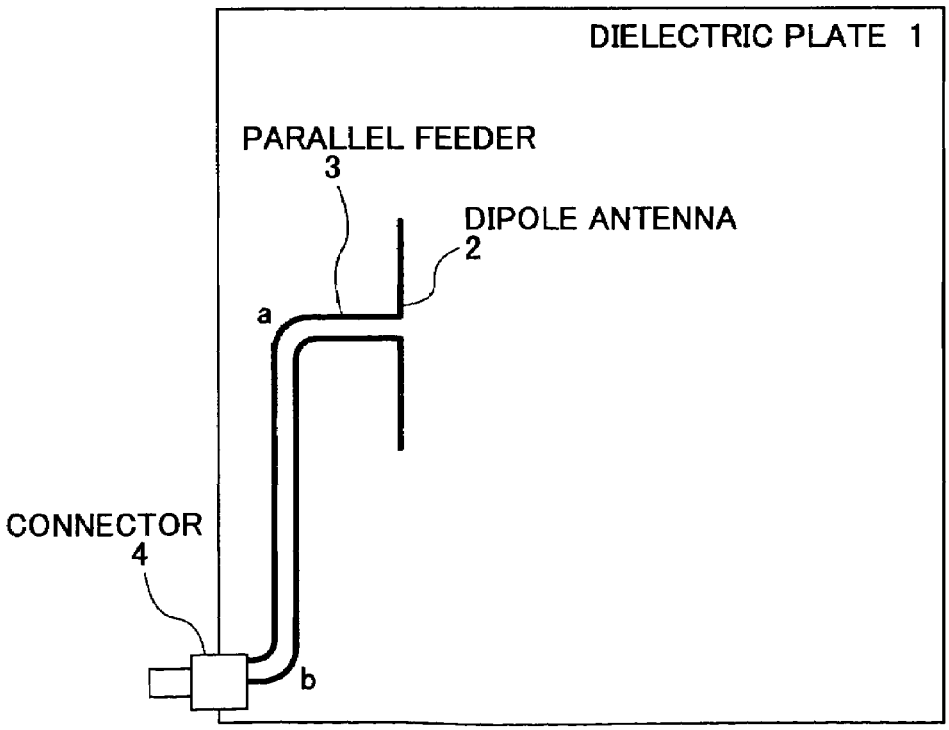
FIG. 2 illustrates a second embodiment of the present invention.

FIG. 2 illustrates a second embodiment of the present invention, wherein elements identical to those in FIG. 1 bear the same reference numbers. In the second embodiment, a feeder 3 has a total length of an integral multiple of a half wavelength, and each bending point a, b of the feeder 3 has a predetermined curvature but not a right angle. The number of the bending points a, b is an even number, so the lengths of two lines of the parallel feeder 3 between a connector 4 and a feeding point of an antenna element are equal. The bending points a, b are curved as described above, so the radiated field from the bending points a, b is lowered compared to right-angle bending points.

Third Embodiment

Figure 3A:
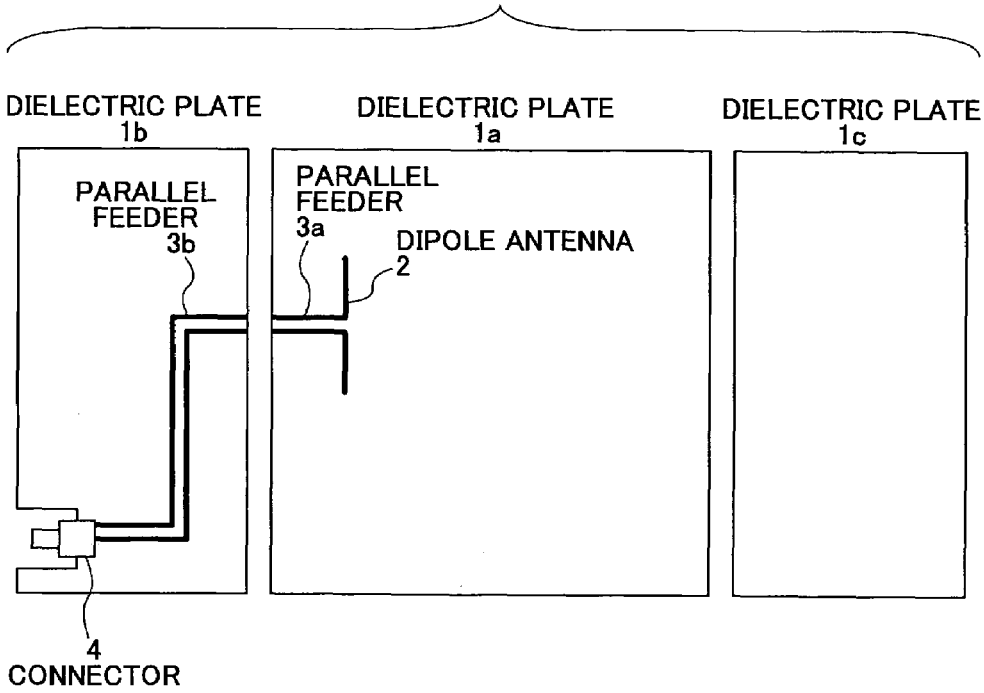
FIGS. 3A and 3B illustrate a third embodiment of the present invention.
Figure 3B:
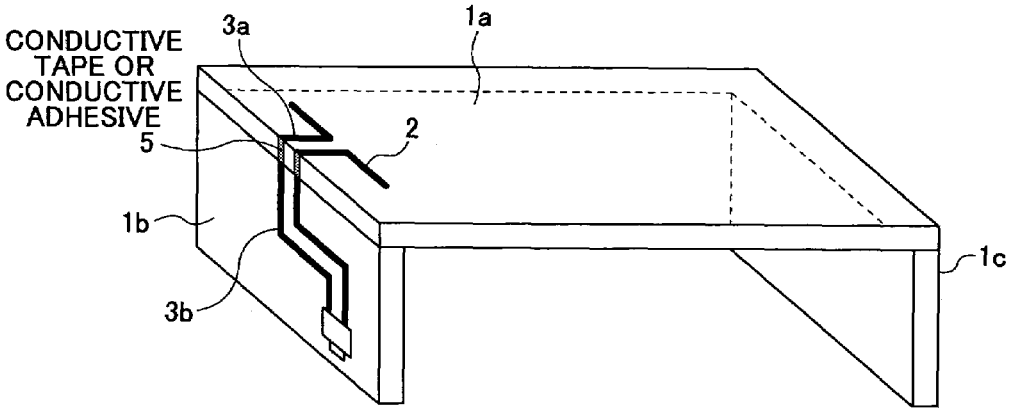

FIG. 3A shows a schematic exploded view of a third embodiment of the present invention, while FIG. 3B shows a perspective view of the third embodiment in the assembled condition. With reference to FIG. 3A, there are provided a dielectric upper plate 1*a* and dielectric side plates 1*b*, 1*c*. A dipole antenna 2 and a parallel feeder 3*a* are disposed on the upper plate (first dielectric plate) 1*a*. A connector 4 is attached to the side plate (second dielectric plate) 1*b*. A feeder 3*b* is also formed on the side plate 1*b* so as to connect the connector 4 to the feeder 3*a* on the upper plate 1*a*. The upper plate 1*a* and the side plates 1*b*, 1*c* are assembled in a table-like shape as shown in FIG. 3B. The feeder 3*a* on the upper plate 1*a* and the feeder 3*b* on the side plate 1*b* are connected through a connection portion 5 formed of a conductive tape or conductive adhesive.

In the second embodiment, as in the first embodiment, the total length of the feeders 3*a*, 3*b* is an integral multiple of a half wavelength, and an even number of bending points are formed in order to equalize the lengths of two lines of the parallel feeder 3. The side plate 1*c* may be formed of a material different from the upper plate 1*a* and the side plate 1*b* because the side plate 1*c* does not have an antenna or a feeder thereon. While the upper plate 1*a* and the side plates 1*b*, 1*c* are assembled in a table-like shape, they may be assembled in a box shape by adding a front plate and/or a rear plate.

Fourth Embodiment

Figure 4A:
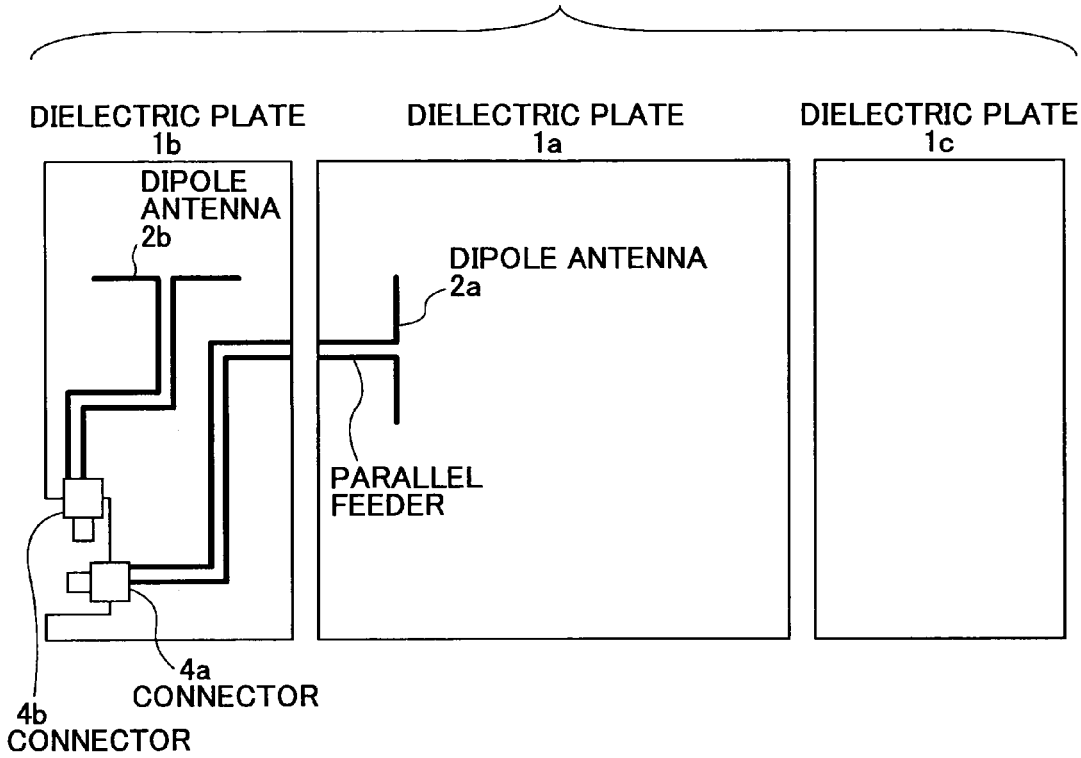
FIGS. 4A and 4B illustrate a fourth embodiment of the present invention.
Figure 4B:
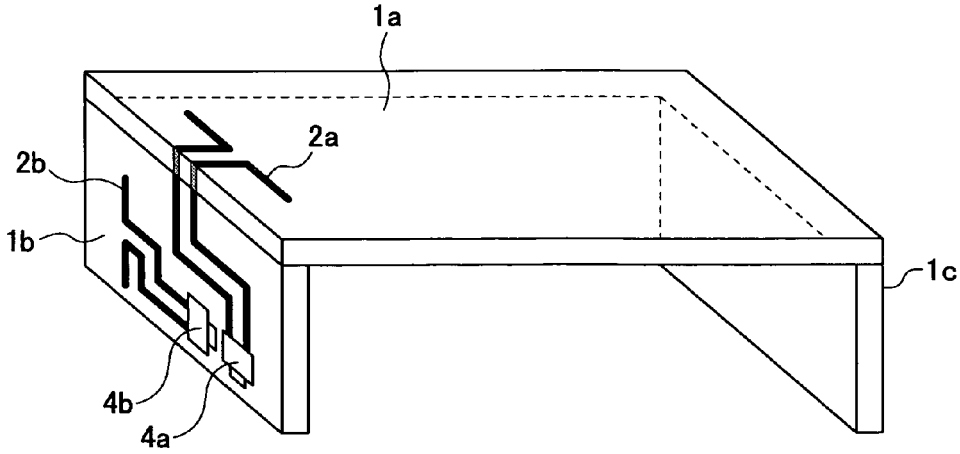

FIG. 4A shows a schematic exploded view of a fourth embodiment of the present invention, while FIG. 4B shows a perspective view of the fourth embodiment in the assembled condition. Referring to FIG. 4A, the fourth embodiment is the same as the third embodiment of FIGS. 3A and 3B in that a first dipole antenna 2*a*, connector 4*a*, and a parallel feeder are provided on an upper plate (first dielectric plate) 1*a*, although it is different in that a second dipole antenna 2*b*, a connector 4*b*, and a parallel feeder interconnecting the second dipole antenna 2*b* and the connector 4*b* are provided on a side plate (second dielectric plate) 1*b*. The dielectric plates are assembled in a table-like shape as shown in FIG. 4B. The feeder on the upper plate 1*a* and the feeder on the side plate 1*b* are connected by a conductive tape or conductive adhesive. With this configuration, the dipole antennas 2*a*, 2*b* can offset the null directions of each other, because the polarization direction of the first dipole antenna 2*a* provided on the upper plate 1*a* is orthogonal to the polarization direction of the second dipole antenna 2*b* provided on the side plate 1*b*.

Fifth Embodiment

Figure 5A:
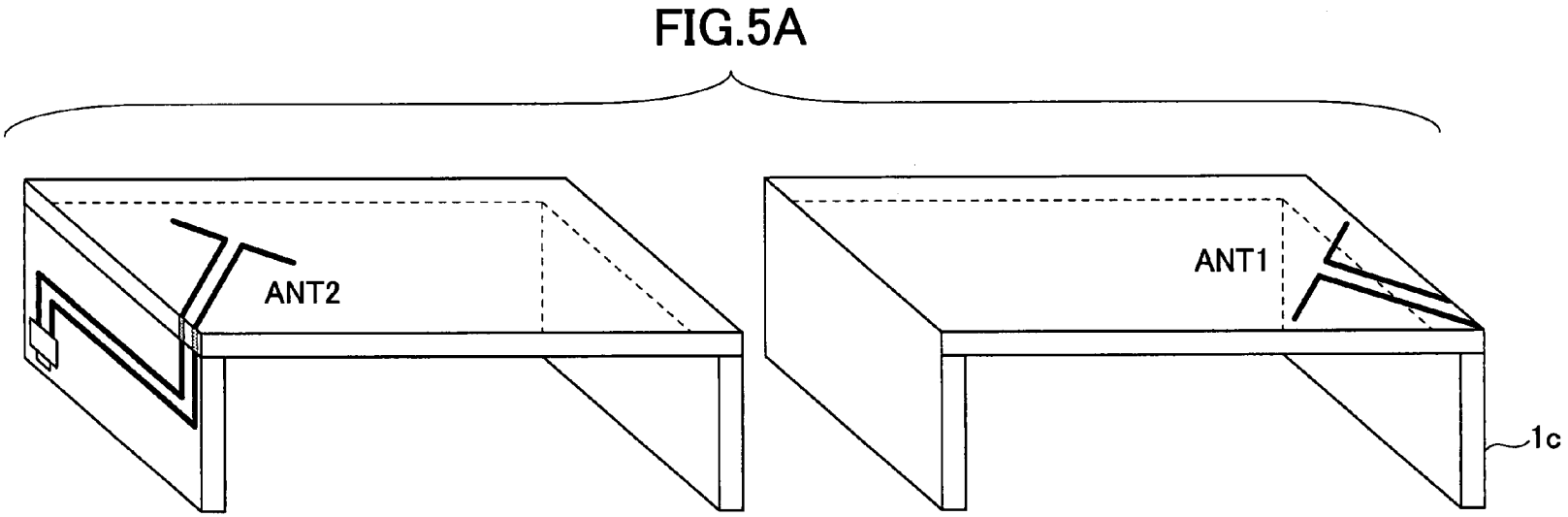
FIGS. 5A and 5B illustrate a fifth embodiment of the present invention.
Figure 5B:
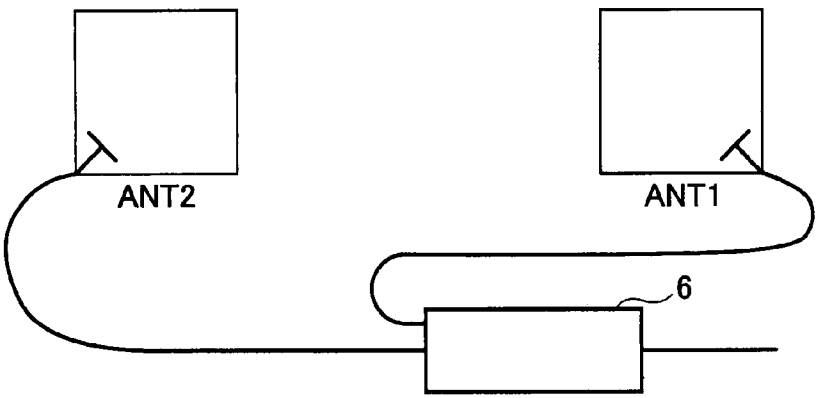

FIG. 5A shows a schematic perspective view of a fifth embodiment of the present invention, while FIG. 5B shows a control configuration of the fifth embodiment. With reference to FIG. 5A, a first dipole antenna ANT1 and a second dipole antenna ANT2 are disposed one on each table so as to be orthogonal to each other. As in the third embodiment of FIGS. 3A and 3B, a first connector provided on a side plate of the corresponding table is connected to a first dipole antenna ANT1 through a parallel feeder. Likewise, although not shown, a second connector provided on a side plate of the corresponding table is connected to a second dipole antenna ANT2 through a parallel feeder. Each of the parallel feeders has a length of an integral multiple of a half wavelength, and has an even number of bending points if any. Power is supplied from a feeder section including a distributor 6 with 90 degrees phase difference. Due to the orthogonal positional relationship and the feeding phase difference between the first and second antennas ANT1 and ANT2 as described above, a circularly polarized wave can be obtained. While the first and second dipole antennas ANT1, ANT2 are disposed on separate tables in this embodiment, they may be disposed on the same table in the arrangement pattern shown in FIG. 5A.

Figure 6:
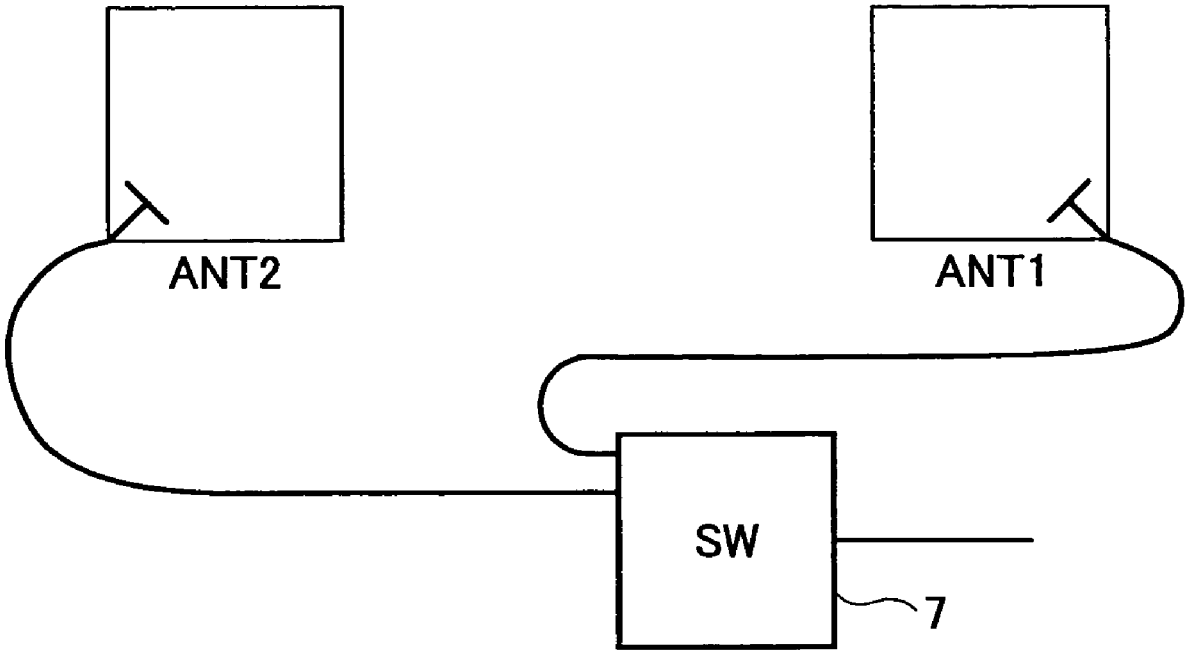
FIG. 6 illustrates a fifth embodiment of the present invention that allows switching between two antennas.

As shown in FIG. 6, a feeder section including a switch 7 such as a pin diode switch may be provided. With the feeder section, the first and second dipole antennas ANT1, ANT2 can be switched to establish radio communications while offsetting null directions thereof.

Figure 7:
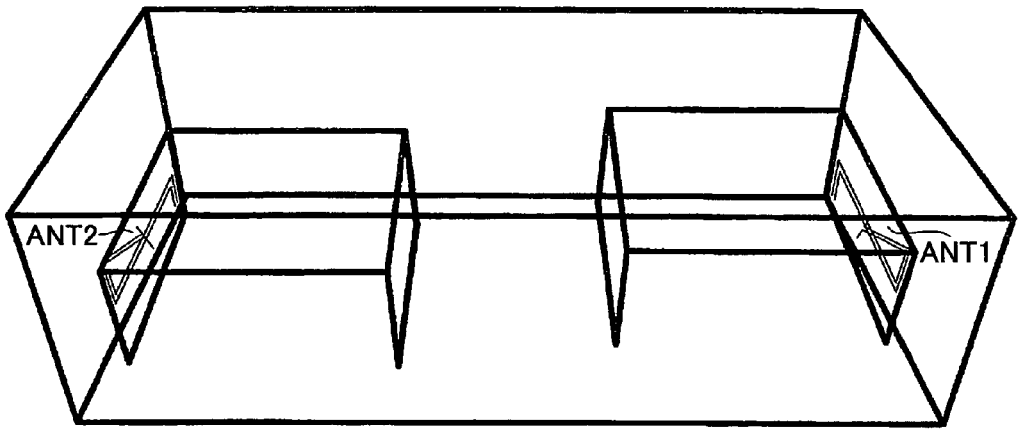
FIG. 7 is a schematic perspective view of a showcase.
Figure 8:
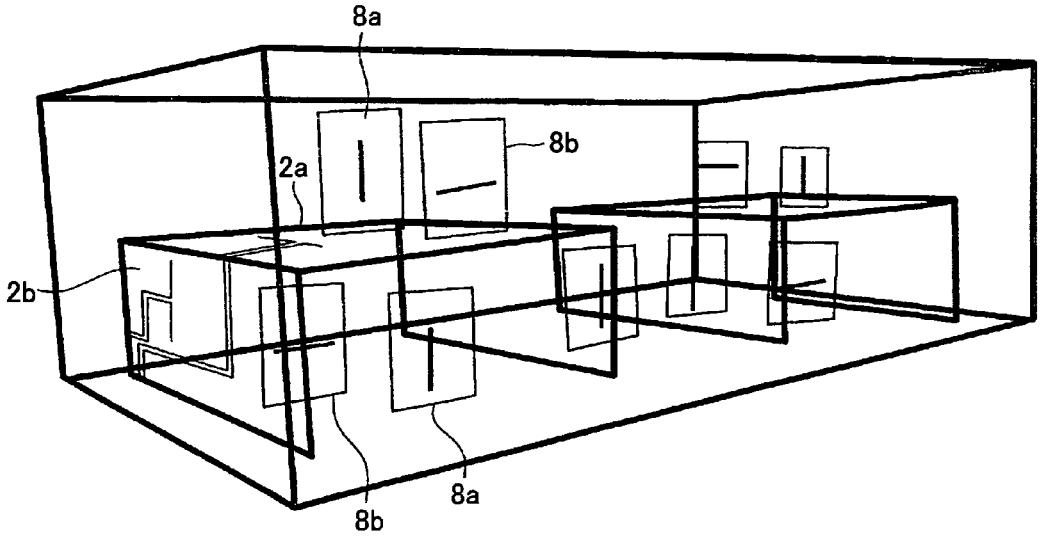
FIG. 8 is a schematic perspective view showing a showcase with RFID tags and antennas disposed therein.
Figure 9:
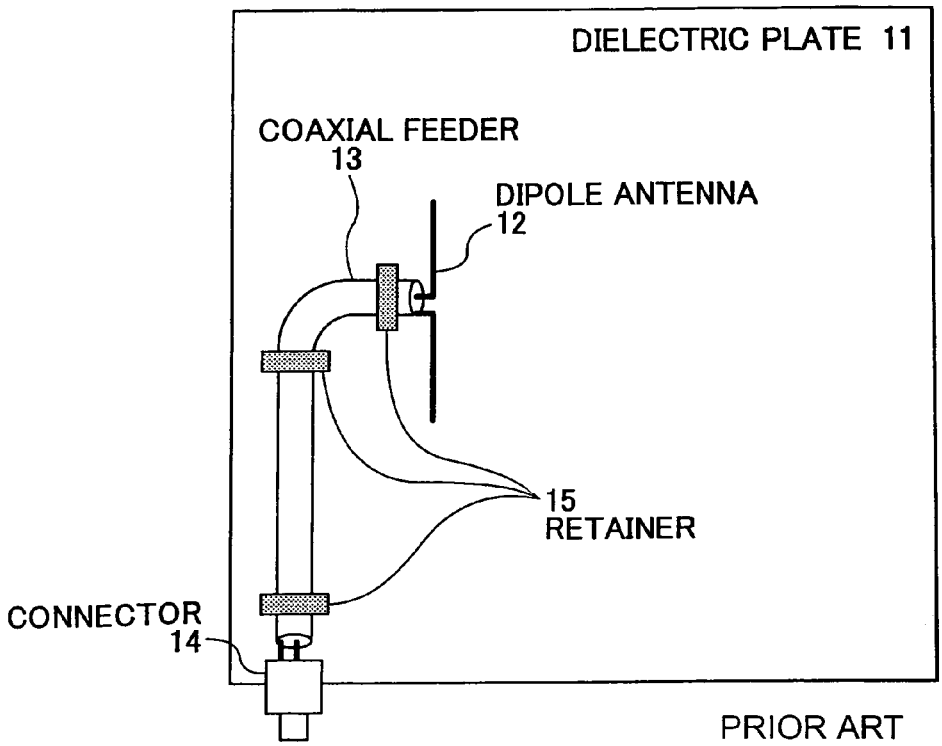
FIG. 9 illustrates a related-art antenna device.
Figure 10:
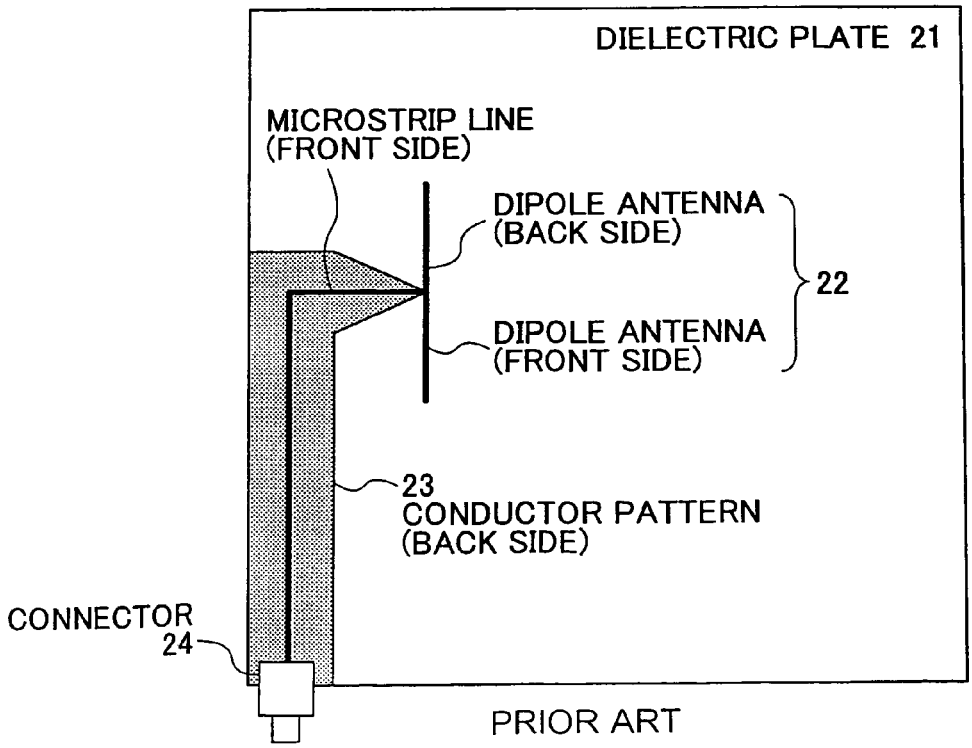
PRIOR ART FIG.10
FIG. 10 illustrates another related-art antenna device.
Figure 11:
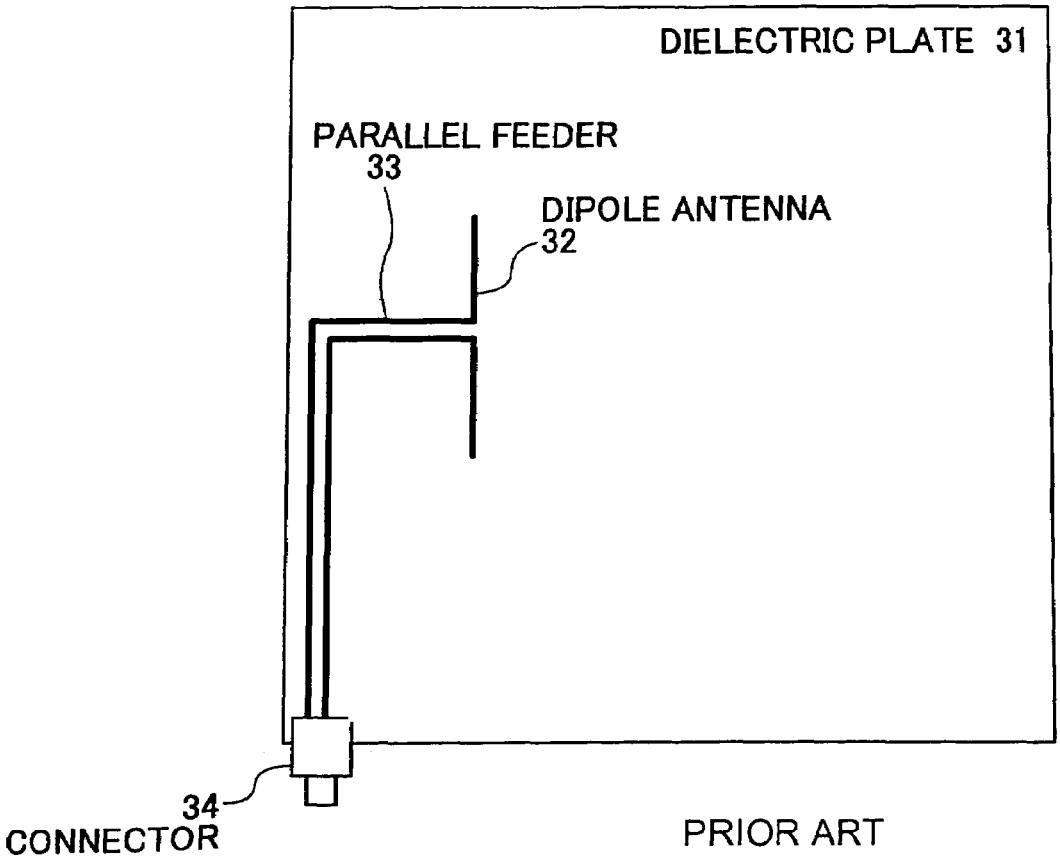
FIG. 11 illustrates still another related-art antenna device.

FIG. 7 is a schematic illustration of a showcase, in which tables having first and second antennas ANT1 and ANT2, respectively, as shown in FIGS. 5A and 5B are disposed therein. FIG. 8 illustrates another showcase in which the tables having a first dipole antenna 2*a* on an upper plate and a second dipole antenna 2*b* on a side plate as described in the fourth embodiment with reference to FIGS. 4A and 4B are disposed. RFID tags 8*a* having vertical antennas and RFID tags 8*b* having horizontal antennas provided in the showcase can exchange information between each other. The RFID tags 8*a* and 8*b* are attached to goods displayed in the showcase. A display device (not shown) receives goods information stored in the RFID tags 8*a* and 8*b* so as to display the goods information.

The present application is based on Japanese Priority Application No. 2005-048230 filed on Feb. 24, 2005, with the Japanese Patent Office, the entire contents of which are hereby incorporated by reference.

What is claimed is:

1. An antenna device, comprising:

a dielectric plate;

an antenna formed of a conductor pattern and disposed on the dielectric plate;

a connector disposed on the dielectric plate; and a parallel feeder formed of a conductor pattern to connect the antenna to the connector, wherein the parallel feeder has a length of an integral multiple of a half wavelength and has an even number of bending points between the connector and the antenna.

2. The antenna device as claimed in claim 1, wherein the bending points of the parallel feeder are curved.

3. An antenna device, comprising:

a dielectric plate;

an antenna formed of a conductor pattern and disposed on the dielectric plate;

a connector disposed on the dielectric plate; and a parallel feeder formed of a conductor pattern to connect the antenna to the connector; wherein the parallel feeder includes a first parallel feeder part, and a second parallel feeder part having one end connected to the first parallel feeder part and the other end connected to the connector;

the dielectric plate includes a first dielectric plate portion on which the first parallel feeder part and the antenna are disposed, and a second dielectric plate portion which is fixed to the first dielectric plate portion to be substantially orthogonal to the first dielectric plate portion and on which the connector and the second parallel feeder part are arranged; and the parallel feeder has a length of an integral multiple of a half wavelength and has an even number of bending points between the connector and the antenna.

* * * * *